US010273654B2

(12) United States Patent
Rutherford

(10) Patent No.: US 10,273,654 B2
(45) Date of Patent: Apr. 30, 2019

(54) CONTROL SYSTEM TO ADJUST APPLIED SLEWING POWER

(71) Applicant: Caterpillar Inc., Peoria, IL (US)

(72) Inventor: Stephen Platt Rutherford, Edwards, IL (US)

(73) Assignee: Caterpillar Inc., Deerfield, IL (US)

( * ) Notice: Subject to any disclaimer, the term of this patent is extended or adjusted under 35 U.S.C. 154(b) by 154 days.

(21) Appl. No.: 15/611,877

(22) Filed: Jun. 2, 2017

(65) Prior Publication Data

US 2018/0347146 A1 Dec. 6, 2018

(51) Int. Cl.

| | |
|---|---|
| ***E02F 3/32*** | (2006.01) |
| ***E02F 9/12*** | (2006.01) |
| ***E02F 9/20*** | (2006.01) |

(52) U.S. Cl.

CPC ..... *E02F 9/123* (2013.01); *E02F 3/32* (2013.01); *E02F 9/2037* (2013.01)

(58) Field of Classification Search

CPC combination set(s) only.

See application file for complete search history.

(56) References Cited

U.S. PATENT DOCUMENTS 5,823,369 A * 10/1998 Kuromoto ..... B25J 9/1638 212/273
2017/0089044 A1* 3/2017 Chitty ..... E02F 9/267
2017/0107692 A1* 4/2017 Robertson ..... E02F 3/48

* cited by examiner

*Primary Examiner* — Aaron L Troost

(57) ABSTRACT

A control system for a machine includes a boom position sensor to generate signals indicative of a boom position, a stick position sensor to generate signals indicative of a stick position, and an operator input sensor to enable an operator to input a slewing power demand and generate signals indicative of the slewing power demand. The control system includes a controller communicably coupled to the boom position sensor, the stick position sensor, and the operator input sensor. The controller creates a dynamic stress model of the machine based on at least one of the boom position and the stick position. The controller receives the signals indicative of the slewing power demand. The controller determines an applied slewing power threshold based on the dynamic stress model. The controller compares the slewing power demand with the applied slewing power threshold and adjusts the applied slewing power based on the comparison.

20 Claims, 3 Drawing Sheets

CONTROL SYSTEM TO ADJUST APPLIED SLEWING POWER

TECHNICAL FIELD

The present disclosure generally relates to adjustment of slewing power of a machine. More specifically, the present disclosure relates to a control system to adjust an applied slewing power of the machine.

BACKGROUND

Machines, such as excavators and power shovels, may include a deck or other platform that rotates above continuous tracks, wheels, pontoons, etc. Extending from the deck, the machine may further include a boom for an articulated arm or crane designed to operate a bucket, a breaker, a hook, or any other such work tool. Accordingly, such machines typically include one or more actuators designed to move the tracks, rotate the deck by providing the slewing power, and operate the articulated arm.

By way of example, an excavator or power shovel may typically operate in work cycles which may include digging, lifting, swinging, dumping, and returning steps for operating a bucket to dig and load fragmented rock, earth, minerals, overburden, and the like for mining or construction purposes. The operation of rotating the deck of the machine is generally achieved by applying slewing power via a motor or other such powering means. Most of the time, various components of the machine are designed to make the machine capable of operating under heavy loads and bear the structural stresses up to a maximum limit defined by the system design requirements. Further, an existing or older machine may be put to handle operations like dredging, or any other such operation requiring to rotate the deck under heavy load on the bucket. The slewing power is generally increased by the operator in such situations to successfully operate under heavy resistance to the movement of the upper deck. However, an increased slewing power along with the heavy load of the bucket may lead to structural damage in certain situations. This may affect structural integrity of the machine, safety of the operator, and any probability of utilizing the existing or older machines to handle dredging like operations.

U.S. Pat. No. 5,823,369 (hereinafter referred to as '369 reference) describes control device for automatically stopping swiveling of a crane. The '369 reference includes stopping the crane based upon calculations related to inertial moment of the rotary body and inertial moment of the load. However, the '369 reference does not disclose details about any solution for continuous operation of the machine without stopping the swiveling movement.

Therefore, an improved control system for controlling slewing power of the machine is required.

SUMMARY

In an aspect of the present disclosure, a control system for a machine having an upper body structure and an undercarriage structure is provided. The control system includes a boom position sensor to generate signals indicative of a boom position, a stick position sensor to generate signals indicative of a stick position, and an operator input sensor to enable an operator to input a slewing power demand and generate signals indicative of the slewing power demand. The control system further includes a controller in communication with the boom position sensor, the stick position sensor, and the operator input sensor. The controller receives signals indicative of the boom position and the stick position. The controller creates a dynamic stress model of the machine based on at least one of the boom position and the stick position. The controller receives signals indicative of the slewing power demand. The controller determines an applied slewing power threshold based on the dynamic stress model. The controller then compares the slewing power demand with the applied slewing power threshold. Further, the controller adjusts the applied slewing power based on the comparison.

In another aspect of the present disclosure, a method for adjusting an applied slewing power to rotate an upper body structure of a machine about an undercarriage structure of the machine is disclosed. The method includes receiving boom position from a boom position sensor by a controller. The method includes receiving stick position from a stick position sensor by the controller. The method includes creating a dynamic stress model of the machine based on at least one of the boom position and the stick position by the controller. The method includes determining an applied slewing power threshold based on the dynamic stress model by the controller. The method includes receiving a slewing power demand from an operator input sensor by the controller. The method includes comparing the slewing power demand with the applied slewing power threshold by the controller. The method further includes adjusting the applied slewing power based at least on the comparison by the controller.

In yet another aspect of the present disclosure, a machine is disclosed. The machine includes an undercarriage structure, an upper body structure coupled to the undercarriage structure and adapted to rotate about the undercarriage structure. The machine includes boom rotatably coupled to the upper body structure, a stick rotatably coupled to the boom, an operator input sensor configured to generate signals indicative of the slewing power demand, and a stick position sensor and a boom position sensor to generate signals indicative of a stick position and a boom position respectively. The machine also includes a controller in communication with the boom position sensor, the stick position sensor, and the operator input sensor. The controller receives signals indicative of the boom position and stick position from the boom position sensor and the stick position sensor respectively. The controller creates a dynamic stress model of the machine based on at least one of the boom position and the stick position. The controller receives the signals indicative of the slewing power demand from the operator input sensor. The controller determines an applied slewing power threshold based on the dynamic stress model. The controller then compares the slewing power demand to the applied slewing power threshold. Further, the controller adjusts the applied slewing power based at least on the comparison.

DETAILED DESCRIPTION

Figure 1:
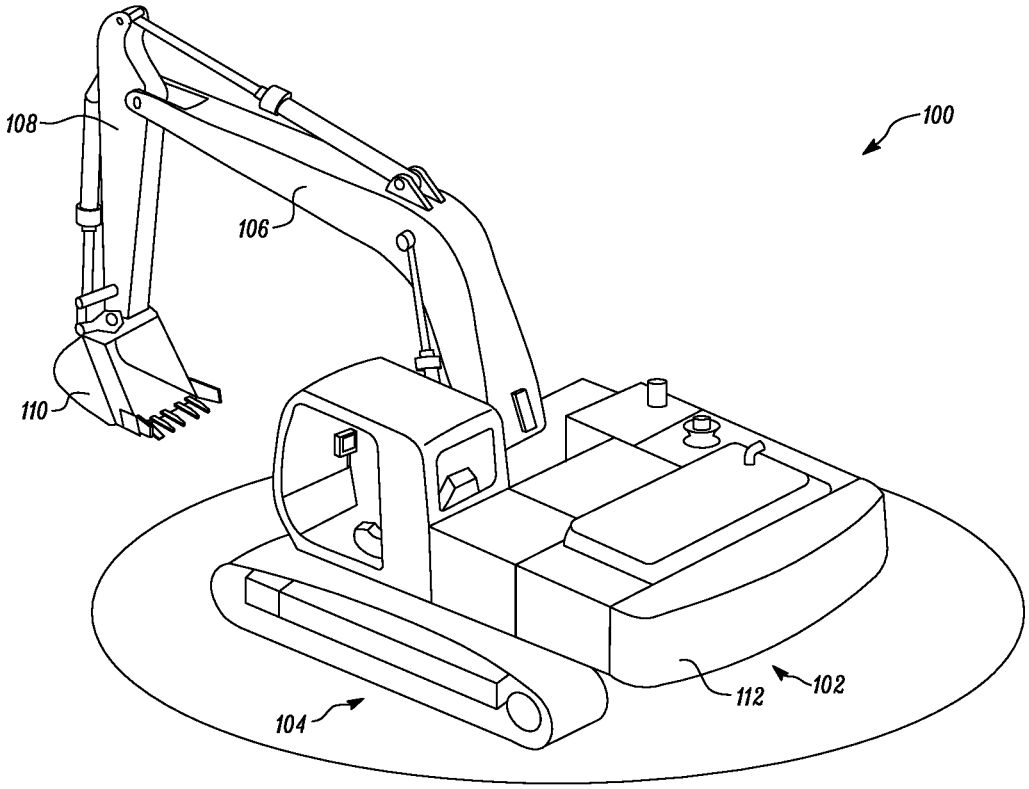
FIG. 1 is a perspective view of an exemplary machine, in accordance with an embodiment of the present disclosure.

Wherever possible, the same reference numbers will be used throughout the drawings to refer to same or like parts. FIG. 1 shows an exemplary machine 100. The machine 100 is illustrated as a hydraulic excavator which may be used, for example, for construction and other allied industries. While the following detailed description describes an exemplary aspect in connection with the hydraulic excavator, it should be appreciated that the description applies equally to the use of the present disclosure in other machines as well.

The machine 100 includes an upper body structure 102 coupled to an undercarriage structure 104. Although, the undercarriage structure 104 is illustrated as continuous tracks, it should be contemplated that the undercarriage structure 104 may be any other type of ground engaging element as well, for example, wheels etc. The upper body structure 102 rotates about the undercarriage structure 104 on application of slewing power. In an embodiment, the slewing power may be applied to the upper body structure 102 by using a power drive (not shown) capable of working with the machine 100. In some embodiments, the slewing power may be applied using a pneumatic, hydraulic, mechanical, or other such suitable power drives.

The machine 100 further includes a boom 106 rotatably coupled to the upper body structure 102, and a stick 108 rotatably coupled to the boom 106. A bucket 110 is rotatably coupled to the stick 108. The bucket 110 may be operated by controlling movement of the boom 106 and the stick 108. Additionally, the upper body structure 102 includes a counterweight 112 provided at a tail end.

Figure 2:
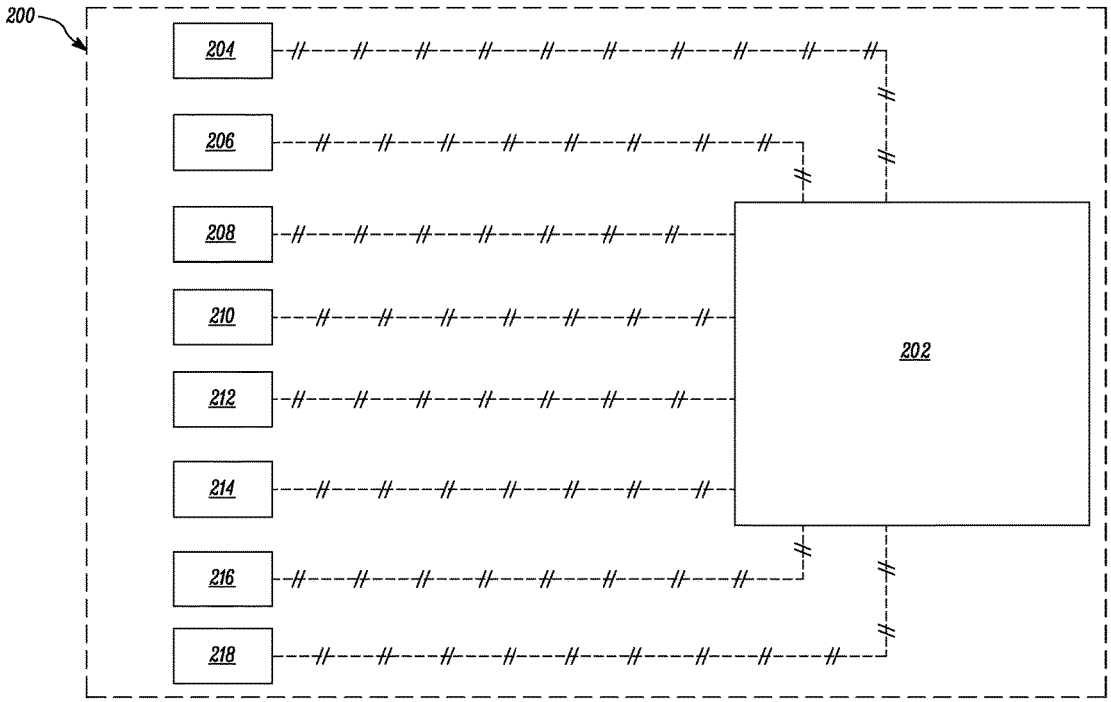
FIG. 2 is a block diagram schematically depicting a control system for the machine, in accordance with an embodiment of the present disclosure.

Now referring to FIG. 2, a control system 200 to adjust an applied slewing power to rotate the upper body structure 102 about the undercarriage structure 104, is illustrated. The control system 200 includes a controller 202 in communication with the upper body structure 102, the undercarriage structure 104, and the work tool 106. The controller 202 may be a single controller or multiple controllers working together to perform a variety of tasks. The controller 202 may embody a single or multiple microprocessors, field programmable gate arrays (FPGAs), digital signal processors (DSPs), etc., that include a means for providing the slewing power to the upper body structure 102. Numerous commercially available microprocessors can be configured to perform the functions of the controller 202. Various known circuits may be associated with the controller 202, including power supply circuitry, signal-conditioning circuitry, actuator driver circuitry (i.e., circuitry powering solenoids, motors, or piezo actuators), and communication circuitry. Various functions of the controller 202 and respective applications are described later in the disclosure.

The control system 200 includes a boom position sensor 204, a stick position sensor 206, and an operator input sensor 208 communicably coupled to the controller 202. The boom position sensor 204 is coupled to the boom 106 and generates signals indicative of a boom position. The stick position sensor 206 is coupled to the stick 108 and generates signals indicative of a stick position. In an embodiment, the boom position sensor 204 and the stick position sensor 206 are rotation sensors. The operator input sensor 208 enables an operator (not shown) to input a slewing power demand and generates signals indicative of the slewing power demand.

Further referring to FIG. 2, the control system 200 may include a plurality of strain sensors 210. In an embodiment, the plurality of strain sensors 210 may be coupled to the machine 100 in such a way that a magnitude of structural stress may be estimated. In some embodiments, the plurality of strain sensors 210 may be coupled to the upper body structure 102, the undercarriage structure 104, the boom 106, the stick 108, and to the bucket 110. The plurality of strain sensors 210 may send signals indicative of the magnitude of the structural stress to the controller 202. The control system 200 may include a machine tilt angle sensor 212 to measure a machine tilt angle. In an embodiment, the machine tilt angle sensor 212 may include any sensor capable of determining an angular orientation of the upper body structure 102, the boom 106, the stick 108, and of the bucket 110 relative to the ground.

The control system 200 may further include a weight sensor 214 and a position sensor 216 coupled to the bucket 110. At least one of the weight sensor 214 may send a weight of a material being carried by the bucket 110 to the controller 202, and the position sensor 216 may send a position of the bucket 110 to the controller 202. The control system 200 may also include a swing speed sensor 218 which sends an actual swing speed of the upper body structure 102 to the controller 202. It must be contemplated that the various sensors described in this disclosure may include any suitable sensor known in the art for the described applications. In some embodiments, the various sensors may include analog sensors, digital sensors, or a combination of analog and digital sensors. In other embodiments, the sensors may include mechanical, optical, laser, or any other such suitable sensors known in the art.

It should be contemplated that the control system 200 may include various other sensors as well to measure various other parameters related to the machine 100. In some embodiments, the control system 200 may be positioned onboard the machine 100. In other embodiments, the control system 200 may be partially positioned at an off-board location relative to the machine 100. The present disclosure, in any manner, is not restricted to the type of controller 202 as well as the type of sensors coupled to the machine 100.

With combined reference to FIGS. 1-2, the machine 100 is operating. The boom position sensor 204 measures the boom position and generates signals indicative of the boom position. The controller 202 receives signals indicative of the boom position from the boom position sensor 204. The stick position sensor 206 measures the stick position and generates signals indicative of the stick position. The controller 202 receives signals indicative of the stick position from the stick position sensor 206. The operator input sensor 208 detects the slewing power demand from the operator and generates signals indicative of the slewing power demand. The controller 202 receives signals indicative of the slewing power demand from the operator input sensor 208.

The controller 202 creates a dynamic stress model of the machine 100 based on at least one of the boom position and the stick position. Additionally, or alternatively, the controller 202 creates the dynamic stress model based only on the boom position or based only on the stick position. Additionally, or, alternatively, the controller 202 creates the dynamic stress model based on both the boom position and the stick position. In an embodiment, the dynamic stress model may define a relationship between various components of the machine 100 describing structural and other applicable forces in real time. In another embodiment, the dynamic stress model may describe individual safety limits for structural stresses in various components of the machine 100. In some embodiments, the dynamic stress model may describe the inter-relationship between individual safety limits for structural stresses of various components of the machine 100 based on factors, for example, nature and magnitude of relative movement between various components, real time stress on various components, among others.

In some embodiments, the controller 202 may update the dynamic stress model in real time based upon the magnitude of structural stress received from the plurality of strain sensors 210. Additionally, or alternatively, the controller 202 may update the dynamic stress model based on the structural stress received from one of the plurality of strain sensors 210 mounted on the boom 106, the stick 108, and the bucket 110.

In an embodiment, the machine tilt angle may be also used by the controller 202 to create the dynamic stress model of the machine 100. In some embodiments, the angular orientation defined by the machine tilt angle may be used by the controller 202 to update the structural stresses of various components in real time. For example, if the machine 100 is operating uphill, the machine tilt angle may be used to increase the slewing power to provide additional assistance while remaining well within the safety limits. In other embodiments, the controller 202 may use the weight of the material being carried by the bucket 110 to create the dynamic stress model of the machine 100. In an embodiment, the weight may affect the structural stresses of the boom 106, the stick 108, and the bucket 110. In other embodiments, the weight of the material may necessitate an increase in the slewing power to provide additional assistance. Further, the weight of the material being carried may also affect the overall center of gravity of the machine, necessitating update of the slewing power.

In an embodiment, the controller 202 may use the position of the bucket 110 to create the dynamic stress model of the machine 100. In other embodiments, the controller 202 may use the real time position of the bucket 110 to update the dynamic stress model in real time. Additionally, or alternatively, the position of the bucket 110 may be used by the controller 202 to decrease the slewing power in situations, for example, a side-dragging bucket 110, among others.

In an embodiment of the machine 100, individual and relative movements of the boom 106, the stick 108, and the bucket 110 may be used by the controller 202 for creating and updating the dynamic stress model. For example, if the actual swing speed is lower than the requested swing speed, the controller 202 may increase the applied slewing power. Additionally, or alternatively, the controller 202 may decrease the slewing power demand if the actual swing speed is higher than the requested swing speed. In some embodiments, the controller 202 may receive the actual swing speed of the upper body structure 102 and update the dynamic stress model in real time.

The controller 202 further determines an applied slewing power threshold based on the dynamic stress model of the machine 100. In an embodiment, the applied slewing power threshold may be defined by a maximum permissible magnitude of the slewing power under which the machine 100 may operate safely without reaching dangerous levels of structural stress. In some embodiments, the applied slewing power threshold may be the maximum slewing power feasible under various limits of structural stresses of various components of the machine 100. In some embodiments, the applied slewing power threshold increases when the boom 106 is raised and decreases when the boom 106 is lowered. For example, the machine 100 experiences increased load when the boom 106 is being raised than when the boom 106 is being lowered. The increased load may warrant for a consecutive increase in the applied slewing power threshold.

In other embodiments, the applied slewing power threshold increases when the stick 108 is retracted and decreases when the stick 108 is extended. The retracting stick 108 affects the overall working envelope of the boom 106, the stick 108, and the bucket 110 as the moment of inertia decreases with the retracting stick 108. With decrease in the moment of inertia, the applied slewing power threshold may be increased. But, the moment of inertia increases with an extension of the stick 108, decreasing the applied slewing power threshold. The controller 202 compares the slewing power demand with the applied slewing power threshold. The controller 202 then adjusts the applied slewing power demand based on the comparison.

INDUSTRIAL APPLICABILITY

Figure 3:
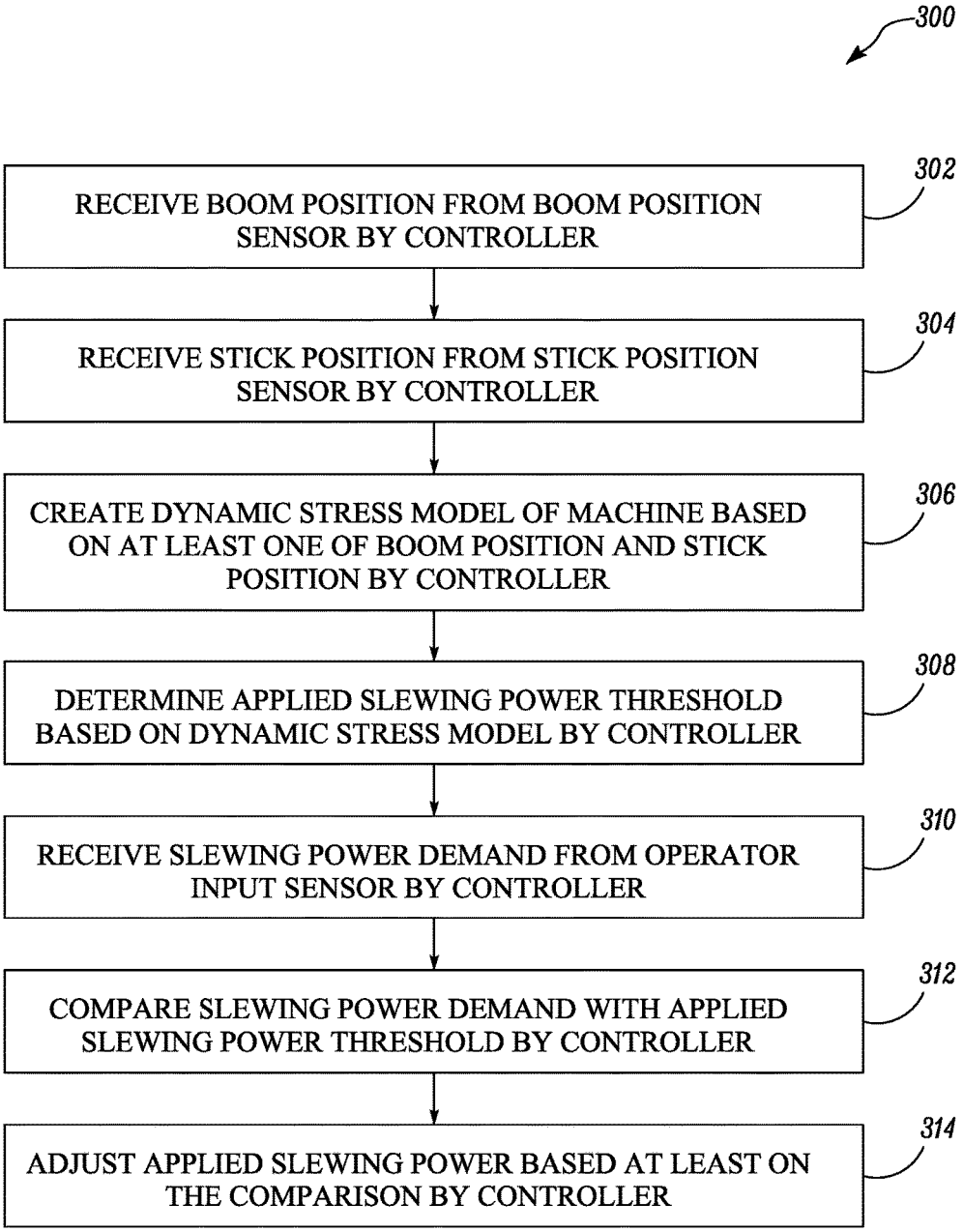
FIG. 3 is a flow chart depicting a method of adjusting an applied slewing power to rotate an upper body structure of the machine about an undercarriage structure, in accordance with an embodiment of the present disclosure.

The present disclosure provides an improved method 300 for adjusting the applied slewing power demand to rotate the upper body structure 102 about the undercarriage structure 104 of the machine 100. The method 300 for adjusting the applied slewing power demand is illustrated with the help of FIG. 3. In an embodiment, the machine 100 is switched on and is operating to perform an excavating operation.

The method 300 at step 302 includes receiving the signals indicative of the boom position by the controller 202. The signals may be generated by the boom position sensor 204. The method 300 at step 304 includes receiving the signals indicative of the stick position by the controller 202. The signals may be generated by the stick position sensor 206. The use of position sensors ensures that the structural stresses may be calculated dynamically based upon the real time positions. The method 300 at step 306 includes creating the dynamic stress model of the machine 100 based on at least one of the boom position, and the stick position by the controller 202. The creation of the dynamic stress model provides a real time operable control system 200 capable of adjusting the slewing power demand. This ensures safety of the machine 100 in situations where the operator demands sudden increase in the slewing power demand.

The method 300 at step 308 includes determining the applied slewing power threshold based on the dynamic stress model created by the controller 202. The real time update of the applied slewing power threshold enables a continuous operation of the machine 100 without stopping the slewing movement for avoiding any structural damage. The method 300 at step 310 includes receiving the slewing power demand from the operator input sensor 208 by the controller 202. The method 300 at step 312 includes comparing the slewing power demand with the applied slewing power threshold by the controller 202. The method 300 at step 314 includes adjusting the applied slewing power demand based at least on the comparison by the controller 202.

In some embodiments, the method 300 may further include updating the dynamic stress model in real time. The dynamic stress model may be updated by the controller 202 based upon the any or all of the boom position sensor 204, the stick position sensor 206, the operator input sensor 208. Similarly, the method 300 may include updating the dynamic stress model based on received signals indicative of the strain being experienced by at least one of the boom 106 and the stick 108. In an embodiment, the dynamic stress model and other associated factors along with their respective values are stored in the memory of the controller 202 and may be accessed from outside. This enables the retrofitting of older or existing machines with the control system 200 of the present disclosure without any pricier installation or replacement investment.

Additionally, the method 300 may include adjusting the slewing power demand based on the machine tilt angle. The method 300 may include adjusting the slewing power demand based on at least one of the weight of the material being carried by the bucket 110 or the position of the bucket 110. The method 300 may also include adjusting the slewing power demand based on a difference between a desired swing speed and actual swing speed. This may prove beneficial for extending life of various parts without needing a substantial investment for replacements.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A control system for a machine having an upper body structure and an undercarriage structure, the control system configured to adjust an applied slewing power to rotate the upper body structure about the undercarriage structure, the control system comprising:

a boom position sensor configured to generate signals indicative of a boom position;

a stick position sensor configured to generate signals indicative of a stick position;

an operator input sensor configured to enable an operator to input a slewing power demand, and generate signals indicative of the slewing power demand; and a controller communicably coupled to the boom position sensor, the stick position sensor, and the operator input sensor, wherein the controller is configured to:

receive the signals indicative of the boom position;

receive the signals indicative of the stick position;

create a dynamic stress model of the machine based on at least one of the boom position, and the stick position;

receive the signals indicative of the slewing power demand;

determine an applied slewing power threshold based on the dynamic stress model;

compare the slewing power demand with the applied slewing power threshold; and adjust the applied slewing power based on the comparison.

2. The control system of claim 1, further comprising a plurality of strain sensors communicably coupled to the controller to update the dynamic stress model in real time.

3. The control system of claim 1, further comprising a machine tilt angle sensor configured to send a machine tilt angle to the controller, wherein the machine tilt angle is used in creating the dynamic stress model.

4. The control system of claim 1, further comprising at least one of a weight sensor configured to send a weight of a material being carried by a bucket coupled to the boom to the controller, and a position sensor configured to send a position of the bucket to the controller, wherein at least one of the weight of the material and the position of the bucket is used in creating the dynamic stress model.

5. The control system of claim 4, wherein the boom position sensor and the stick position sensor comprises of rotation sensors.

6. The control system of claim 1, further comprising a swing speed sensor configured to send an actual swing speed of the upper body structure to the controller, wherein the controller further adjusts the slewing power demand based on a difference between a desired swing speed and the actual swing speed.

7. The control system of claim 1, wherein the applied slewing power threshold increases when the boom is raised, and decreases when the boom is lowered.

8. The control system of claim 1, wherein the applied slewing power threshold increases when the stick is retracted, and decreases when the stick is extended.

9. A method for adjusting an applied slewing power to rotate an upper body structure of a machine about an undercarriage structure of the machine, the method comprising:

receiving, by a controller, a boom position from a boom position sensor;

receiving, by the controller, a stick position from a stick position sensor;

creating, by the controller, a dynamic stress model of the machine based on at least one of the boom position, and the stick position;

determining, by the controller, an applied slewing power threshold based on the dynamic stress model;

receiving, by the controller, a slewing power demand from an operator input sensor;

comparing, by the controller, the slewing power demand with the applied slewing power threshold;

adjusting, by the controller, the applied slewing power based at least on the comparison.

10. The method of claim 9, further comprising:

updating, by the controller, the dynamic stress model in real time.

11. The method of claim 9, further comprising:

receiving, by the controller, signals indicative of strain being experienced by at least one of the boom and the stick; and updating, by the controller, the dynamic stress model based on the strain being experienced by at least one of the boom and the stick.

12. The method of claim 9, further comprising:

adjusting, by the controller, the slewing power demand based on a machine tilt angle.

13. The method of claim 9, further comprising:

adjusting, by the controller, the slewing power demand based on at least one of a weight of a material being carried by a bucket coupled to the boom, and a position of the bucket.

14. The method of claim 9, further comprising:

adjusting, by the controller, the slewing power demand based on a difference between a desired swing speed and actual swing speed.

15. A machine comprising:

an undercarriage structure;

an upper body structure coupled to the undercarriage structure, and adapted to rotate about the undercarriage structure;

a boom rotatably coupled to the upper body structure;

a boom position sensor configured to generate signals indicative of a boom position;

a stick rotatably coupled to the boom;

a stick position sensor configured to generate signals indicative of a stick position;

a bucket rotatably coupled to the stick;

an operator input sensor configured to enable an operator to generate a slewing power demand, and generate signals indicative of the slewing power demand; and a controller communicably coupled to the boom position sensor, the stick position sensor, and the operator input sensor, wherein the controller is configured to:

receive the signals indicative of the boom position from the boom position sensor;

receive the signals indicative of the stick position from the stick position sensor;

create a dynamic stress model of the machine based on at least one of the boom position, and the stick position;

receive the signals indicative of the slewing power demand from the operator input sensor;

determine an applied slewing power threshold based on the dynamic stress model;

compare the slewing power demand to the applied slewing power threshold; and adjust the applied slewing power based at least on the comparison.

16. The machine of claim 15, further comprising a swing speed sensor configured to send an actual swing speed of the upper body structure to the controller, wherein the controller further adjusts the slewing power demand based on a difference between a desired swing speed and the actual swing speed.

17. The machine of claim 15, further comprising a machine tilt angle sensor configured to send a machine tilt angle to the controller, wherein the machine tilt angle is used in creating the dynamic stress model.

18. The machine of claim 15, further comprising a plurality of strain sensors to update the dynamic stress model in real time.

19. The machine of claim 15, further comprising at least one of a weight sensor configured to send a weight of a material being carried by a bucket coupled to the boom to the controller, and a position sensor configured to send a position of the bucket to the controller, wherein at least one of the weight of the material being carried by the bucket and the position of the bucket is used in creating the dynamic stress model.

20. The machine of claim 15, wherein the boom position sensor and the stick position sensor comprises of rotation sensors.

* * * * *